US006110886A

United States Patent [19]

Scepanski

[11] Patent Number: 6,110,886

[45] Date of Patent: Aug. 29, 2000

[54] SOLID CAST FABRIC SOFTENING COMPOSITIONS FOR APPLICATION IN A WASHING MACHINE

[75] Inventor: William H. Scepanski, Bloomington, Minn.

[73] Assignee: Sunburst Chemicals, Inc., Bloomington, Minn.

[21] Appl. No.: 09/358,735

[22] Filed: Jul. 21, 1999

Related U.S. Application Data

[63] Continuation of application No. 08/491,475, Jun. 16, 1995, abandoned.

[51] Int. Cl.[7] ..... C11D 1/62; C11D 1/75; C11D 13/16

[52] U.S. Cl. ..... 510/515; 510/287; 510/327; 510/329; 510/330; 510/394; 510/440; 510/445; 510/477; 510/499; 510/503; 510/504

[58] Field of Search ..... 510/287, 327, 510/329, 330, 394, 440, 445, 477, 499, 503, 504, 515

[56] References Cited

U.S. PATENT DOCUMENTS

| | | | |
|---|---|---|---|
| 3,330,665 | 7/1967 | Van Ness et al. . | |
| 3,941,713 | 3/1976 | Dawson et al. . | |
| 3,954,630 | 5/1976 | Ramachandran . | |
| 3,984,356 | 10/1976 | Graham . | |
| 4,057,673 | 11/1977 | Falivene . | |
| 4,128,484 | 12/1978 | Barford et al. . | |
| 4,144,177 | 3/1979 | Minegishi et al. . | |
| 4,210,550 | 7/1980 | Cornelissens . | |
| 4,233,167 | 11/1980 | Sramek . | |
| 4,237,016 | 12/1980 | Rudkin et al. . | |
| 4,268,401 | 5/1981 | Meschkat et al. . | |
| 4,308,024 | 12/1981 | Wells . | |
| 4,427,558 | 1/1984 | David . | |
| 4,446,042 | 5/1984 | Leslie . | |
| 4,497,718 | 2/1985 | Neiditch et al. . | |
| 4,547,300 | 10/1985 | Lareau . | |
| 4,744,911 | 5/1988 | Baeck et al. . | |
| 4,769,159 | 9/1988 | Copeland . | |
| 4,846,990 | 7/1989 | Upadek et al. . | |
| 4,869,836 | 9/1989 | Harmalker . | |
| 4,882,074 | 11/1989 | Kenyon et al. . | |
| 5,093,014 | 3/1992 | Neillie . | |
| 5,368,756 | 11/1994 | Vogel et al. . | |
| 5,445,755 | 8/1995 | Convents et al. | 252/102 |
| 5,460,736 | 10/1995 | Trinh et al. | 252/8.8 |
| 5,482,641 | 1/1996 | Fleisher | 252/90 |
| 5,505,866 | 4/1996 | Bacon et al. | 252/8.6 |
| 5,536,421 | 7/1996 | Hartman et al. . | |
| 5,545,350 | 8/1996 | Baker et al. | 510/517 |
| 5,562,849 | 10/1996 | Wahl et al. | 510/521 |

FOREIGN PATENT DOCUMENTS

| | | |
|---|---|---|
| 1260584 | 1/1972 | United Kingdom . |
| 1494058 | 12/1977 | United Kingdom . |

*Primary Examiner*—Yogendra Gupta
*Assistant Examiner*—Charles Boyer
*Attorney, Agent, or Firm*—Patterson & Keough, P.A.

[57] ABSTRACT

The invention is based on the discovery of the fabric softening ability of fatty amines and dimethyl fatty amine oxides for washer based applications. These amine softeners are combined with other ingredients to form the softening compositions. The softeners will contain a second compound selected from the group consisting of acidic compositions, nonionic surfactants and anionic surfactants, and other ingredients can be added to enhance the character of the fabric softener. Solid cast fabric softeners within the invention include compositions having between 5 and 95 percent by weight citric acid. Citric acid has adventageous properties. These solid citric acid containing fabric softeners will include a cationic surfactant such as a quarternary ammonium salt. Other solid cast fabric softener compositions in the invention have a reducing agent for reducing any remaining hypochlorite bleach. This reducing agent is combined with a fabric softening compound in the composition. A novel method within the invention involves placing a fatty amine into a washing machine at or before a rinse cycle. The washing machine agitates the laundry in the presence of the fatty amine. The washing machine is then drained.

9 Claims, No Drawings

SOLID CAST FABRIC SOFTENING COMPOSITIONS FOR APPLICATION IN A WASHING MACHINE

This application is a continuation of application Ser. No. 08/491,475 filed Jun. 16, 1995, now abandoned.

FIELD OF THE INVENTION

The invention relates to fabric softening compositions used in a washing machine. More specifically, the invention relates to fabric softening compositions based on fatty amines with optional, additional functional ingredients to enhance fabric softness, protect fabrics and aesthetically improve the quality of laundered fabrics along with methods of manufacture and use.

BACKGROUND OF THE INVENTION

Prior to the 1950's fatty acid soaps were the primary ingredients in laundry detergents. While the fatty acid soaps created problems in the presence of hard water, they left fabrics coated with a microscopic residue of fatty soap that left the fabric with a lubricated soft feel. With the advent of synthetic detergents, there developed a need for laundry products that would restore the soft, fluffy feel that is desirable on fabrics. Rinse cycle fabric softeners filled this need. Liquid fabric softeners have been used for many years in both household and commercial laundries.

Commercial and industrial laundries use harsh, highly alkaline detergents to wash fabrics. These harsh detergents thoroughly scour the fabric fibers which results in a rough, scratchy irritating feel after the fabric is dried. The irritating feel to the fabric is especially pronounced with cotton fabrics, but also is found with polyester and cotton/polyester blends. Fabric softening and conditioning agents are applied to the fabric to reduce the harshness by forming a layer of fatty organic substance that has a soft feel. Acidic materials can be incorporated into softeners or conditioners to neutralize excess alkalinity that can contribute greatly to the harsh feel of fabrics and that can damage the fibers when heated at the high temperatures typical of industrial or institutional laundry dryers.

Fabric softeners have usually contained cationic surfactants, especially quaternary ammonium compounds. Fabric softeners have been made in liquid and solid forms and as coatings on small polymeric spheres. The acidified liquid softeners are usually quite dilute by virtue of the low gel forming concentration characteristic of quaternary ammonium compounds and cationic surfactants generally in aqueous acid diluents.

Fabric softening compositions applied in the washing machine have traditionally been liquid products either added by hand or automatically pumped into the final rinse cycle. When used in institutional or industrial applications, acids are often added to the softening composition to neutralize the sodium hydroxide, potassium hydroxide or any other highly alkaline components that carry through the rinse cycles. These products are corrosive by virtue of their acidity and can damage vehicles, equipment, facilities or tissue if spilled while shipping or handling.

U.S. Pat. No. 4,497,718 to Neiditch et al. describes a dilute aqueous liquid softener with 0.5 percent to 10 percent cationic surfactant. This particular softener includes a stilbene sulfonic acid as a fluorescent whitening agent. Weak organic acids, such as citric acid and benzoic acid, are added to adjust the pH to be between 3 and 6. U.S. Pat. No. 4,114,177 to Minegishi et al. describes a fabric softener composition with anionic surfactants and quaternary ammonium salts. The softener composition can be used in the form of a liquid. U.S. Pat. No. 4,308,024 to Wells discloses a liquid fabric softener that has a relatively insoluble cationic detergent, a monocarboxylic acid and a relatively water soluble cationic detergent or a cationic polymer. U.S. Pat. No. 4,427,558 to David describes a fabric softener with a cationic surfactant especially quaternary ammonium salts, urea and calcium soap. The material is preferably formed into a powder and can include detergent compounds.

U.S. Pat. No. 5,093,014 to Neillie discloses the use of amphoteric compounds in the production of liquid fabric softeners. The amphoteric compounds include tertiary amine oxides that are monomethyl. The preferred amine oxides contain two carbon chains with at least 14 carbon atoms. The compositions must contain a coactive material which include cationic, nonionic and semipolar surfactants to prevent phase separation. Great Britain Patent 1,260,584 similarly discloses the use of tertiary amine oxides with two long alkyl chains with 8 to 24 carbon atoms used as fabric softeners.

The potential softening properties of certain nonionic materials have been recognized before. U.S. Pat. No. 4,128,484 to Barford et al. discloses a fabric softener containing a fatty alkyl ester of a polyhydric alcohol. These softeners contain at least 5 percent cationic surfactant. The presence of the cationic surfactant is important in creating the softening effect of the nonionic fatty ester. U.S. Pat. No. 4,237,016 to Rudkin et al. also describes softeners (conditioners) with a nonionic softening agent. The nonionic softeners are fatty esters or fatty alcohols in esters with smaller chained carboxylic acids. The nonionic softeners are present in concentrations of 2 to 10%. The composition also contains 0.3% to 4% cationic surfactant such as quaternary ammonium salts and from 0.05% to 0.5% polymeric cationic salt.

Fabric softeners or conditioners can also be deposited in thin films on insoluble substrates such as spheres or fibers. These softeners are typically for use in a dryer rather than a washer where the heat of the dryer softens or melts the softening composition so that it can transfer to the article of clothing when it comes into contact during the tumbling process. U.S. Pat. No. 4,057,673 discusses a softening composition that includes a plasticizer. The fabric softeners include nonionic, anionic or cationic surfactants. Suitable nonionic surfactants are stated to include fatty esters, fatty amides, fatty ethers, fatty and certain polymers. Plasticizers were found to improve the transfer of the softener to the fabric.

For institutional applications the handling convenience of solid cast cleaning compositions is a significant consideration. U.S. Pat. No. 4,769,159 to Copeland describes a solid cast fabric softening product. These solid softeners include a cationic surfactant, especially a quaternary ammonium salt, and a dicarboxylic acid. The production of the solid product is based on the melting of the cationic surfactant.

Combination products that involve both detergent and a softener are also available. For these products, a relatively neutral pH would typically be used to eliminate or reduce the need to add a later product to adjust the pH. U.S. Pat. No. 4,233,167 to Sramek discloses a liquid detergent with softening and brightening properties. Nonionic surfactants are used for their cleaning properties and a quaternary ammonium salt is used for its softening ability. A long list of suitable nonionic surfactants are given including tertiary amine oxides.

U.S. Pat. No. 4,268,401 to Meschkat et al. a liquid fabric cleaner that also softens. These compositions also contain a nonionic surfactant and a quaternary ammonium softener. The nonionic surfactants are preferably alkylpolyglycol ethers. U.S. Pat. No. 4,547,300 to Lareau describes a product with a nonionic surfactant, a cationic softener and a optical brightening agent. A range of suitable nonionic surfactants are described as including those generally known in the art with certain preferred surfactants enumerated.

Quaternary ammonium chlorides (quats) have served as the major active ingredient in fabric softener formulations for many years and continue to be the primary material of choice for this application. Relevant quats have the structure $[R_4N]^+X^-$, where R can be any length hydrocarbon chain from $C_1$ to $C_{22}$ and $X^-$ is typically chloride or sulfate although other anions can be used. The hydrocarbon chain lengths can be and often are different for the four chains.

Variations in quaternary ammonium chloride composition over the years have been mainly to change the handling characteristics, e.g., viscosities, solubilities, or to change the chloride to sulfate to reduce corrosiveness. Particularly useful quats have substituents that are dimethyl difatty alkyl or trimethyl monofatty alkyl comprising the four R groups characterized by having four carbon atoms chemically bonded to the nitrogen. Imidazolines are also considered quat softeners under this definition.

Quaternary ammonium softeners have a very strong affinity for a surface on which they can absorb. If overused, the quaternary ammonium compound can build up on the fabric causing a property known as "waterproofing" which is undesirable because fabrics meant to absorb liquids will no longer absorb. Quaternary ammonium softeners, which contain large cations, can combine with some large anionic molecules and precipitate. Once precipated, they are no longer able to bind to the fabric and lose their softening ability.

Other materials have been used in liquid products to impart softness to fabrics, in addition to quaternary ammonium salts. U.S. Pat. No. 3,984,356 to Graham describes the use of a dicarboxylic acid salt as the softening agent in a combination laundry detergent and softener product. Mineral oil and paraffin wax emulsions also have been used to provide the lubrication resulting in the soft feel of fabric softeners.

Washer applied fabric softeners have been based on cationic compounds. Quaternary ammonium salts are recognized as some of the best softeners among these cationic compounds. While it has been recognized that nonionics can have softening properties when used in combination with some cationics, the use of washer based nonionic compounds as softeners has been quite limited. This is due to the perceived lack of adherence of nonionics to the fabric. In dryer based applications where melted or softened compounds transfer by contact with the fabric, nonionics and cationics are more readily used.

Commercial or industrial laundries typically use chlorine bleach, i.e., aqueous sodium hypochlorite solutions, to remove stains, whiten linens and sanitize. With the typical washing protocol designed to save water, there will usually be a measurable amount of hypochlorite left in the fabric even after several rinses. The presence of hypochlorite can be detrimental to fabrics because it chemically reacts with the fabric when subjected to the high temperatures in commercial dryers. The result of the reaction with the fabric is to weaken the fabric or produce holes which shorten the useful life of the fabric.

The laundry industry has used "antichlors" to destroy remaining hypochlorite bleach and therefore to reduce the damage to the fabric. Antichlors are reducing agents, usually of the sulfite family, i.e., sulfite, thiosulfite and metabisulfite salts. The sulfites generate an obnoxious odor when acidified.

Consequently, these antichlors have not been added to liquid fabric softeners containing acids. It would be advantageous to have a compound to reduce hypochlorite in an acidic fabric softening product.

SUMMARY OF THE INVENTION

The invention is based on the discovery of the fabric softening ability of fatty amines and dimethyl fatty amine oxides for washer based applications. These amine softeners are combined with other ingredients to form the softening compositions. The amine softeners are present in concentrations greater than about 1 percent by weight. The softeners will contain a second compound selected from the group consisting of acidic compositions, nonionic surfactants and anionic surfactants. Other ingredients can be added to enhance the character of the fabric softener including optical brighteners, fragrance, colorant and defoamer.

Solid cast fabric softeners within the invention include compositions having between 5 and 95 percent by weight citric acid. Citric acid tends to buffer the pH in a range covering the pH of the skin, and chelates with iron ions facilitating their rinsing away from the fabric. These solid fabric softeners will include a cationic surfactant such as a quarternary ammonium salt.

Other solid cast fabric softener compositions in the invention have a reducing agent for reducing any remaining hypochlorite bleach. This reducing agent is combined with a fabric softening compound in the composition. The fabric softening composition may contain an acidic composition.

A novel method within the invention involves placing a fatty amine into a washing machine at or before a rinse cycle. The washing machine agitates the laundry in the presence of the fatty amine. The washing machine is then drained.

DETAILED DESCRIPTION OF THE INVENTION

The present invention extends the use of nonionic compounds as fabric softeners by identifying nonionics that have good adherence properties on fabrics and good softening characteristics. Also, the invention involves the identification of useful softener additives that are especially appropriate for solid cast fabric softeners.

Fatty amines, fatty amine salts and fatty dimethyl amine oxides (a tertiary amine oxide with two methyl substituants and a $C_{12}$ to $C_{22}$ fatty carbon chain) have been found to provide effective fabric softening characteristics. Fatty amines, fatty amine salts and fatty dimethyl amine oxides will together be referred to as amine softeners. The compounds impart a soft feel to fabrics on which they are deposited yet will not cause a greasy coating that will not wash out during the next wash cycle. Amine softeners tend to have better solubility properties relative to quaternary ammonium compounds that have good softening properties. They are also commercially available for a reasonable cost. Therefore, for the formation of liquid or solid cast fabric softeners, these compounds provide considerably improved flexibility in selecting an effective softening composition for a particular application. The concentration of amine softener in the fabric softeners of the present invention is between 1 percent and 100 percent by weight. For solid cast fabric softeners, it is preferred that the amine softener is present in concentrations greater than 20 percent.

In the production of solid cast fabric softeners, especially for institutional or industrial applications, the fatty amines, fatty amine salts and fatty amine oxides will serve as base material for the addition of other ingredients. The base must be solid at room temperature but melt between 100° F. and 220° F. Also, the base must be chemically compatible with ingredients that are to be added to the product. The following is a list of suitable amine softeners for solid cast fabric softeners:

hydrogenated tallow amine, Armeen HT™ sold by AKZO Chemicals;

di(hydrogenated tallow) amine, Armeen 2HT™ sold by AKZO Chemicals;

methyl di(hydrogenated tallow) amine, Armeen M2HT™ sold by AZKO Chemicals;

tallowamine acetate, Armac HT™ sold by AKZO Chemicals;

N, N-dimethyl-1-octadecanamine oxide, Admox SC-1885™ sold by Albemarle Corp.

N, N-dimethyl-1-hexadecanamine oxide, Admox SC-1685™ sold by Albemarle Corp.

N,N-dimethyl-1-tetradecanamine oxide, Admox SC-1485™ sold by Albemarle Corp.

Tallow is a mixture of fatty acids with carbon chain lengths between $C_{12}$ and $C_{22}$, with a large concentration of chain lengths in the $C_{16}$–$C_{18}$ range.

The above amine softeners would also be suitable in aqueous, liquid softening compositions. A wider range of amine softeners will work well in liquid compositions because the melting point will not matter. In the examples below, these amine softeners are compared to a standard of dimethyl dihydrogenated tallow ammonium chloride (Arquad 2HT-75 sold by AKZO Chemicals) which is regarded by many in the industry to provide the best softening characteristics.

Acidic materials can be added to the fabric softeners of the present invention. The acid has to be compatible with the other ingredients in the composition. The preferred acids for laundry applications would tend to buffer near the pH range between 5 and 6.5 which is the pH range of the skin. The acid will be present in concentrations between 0 percent and 70 percent by weight of softening composition. A wide range of acidic materials can be used including, but not limited to:

oxalic acid citric acid gluconic acid tartaric acid nitrilotriacetic acid ethylenediamine tetraacetic acid amino tri(methylene phosphonic) acid 1-hydroxyethylidine-1,1-diphosphonic acid hexamethylene diamine tetra(methylene phosphonic acid)

ammonium or sodium bifluoride ammonium or sodium silicofluoride ammonium or sodium bisulfate ammonium or sodium bisulfite hydroxyacetic acid phosphoric acid sulfamic acid In some applications, it is preferred to use an acid that not only affects the pH, but also is capable of chelating iron over the pH range of 2 to 8. Dissolved iron in both ferric and ferrous oxidation states is found in many water supplies used for laundering fabrics. Iron can enter the water supply from the water source whether groundwater or surface water or from iron pipes either used in the municipal water supply or for plumbing at the site. Even small amounts of dissolved iron, less than 0.5 ppm, can cause white fabrics to yellow or colored fabrics to discolor over time. Water softening equipment used to remove the calcium and magnesium ions from hard water does not completely remove troublesome iron ions from the water.

Acids with no ability to chelate iron are acceptable in laundries with little or no iron in the water and, in these circumstances, would be preferred because they are substantially lower in cost than acids with iron chelating anions. Preferred iron chelating acids include citric acid, gluconic acid and amino tri(methylene phosphonic acid). Citric acid is the most preferred acid material since it acidifies, buffers in the proper range, chelates iron and is mild to fabrics and skin. Preferred non-iron chelating acids include ammonium bifluoride and ammonium silicofluoride.

While antichlors are not stable in aqueous acidic solutions, it is found that they are stable in solid acidified fabric softeners. These reducing agents are not inactivated during the production process of making the solid cast fabric softener. Antichlors that can be used in fabric softeners of the invention include, but are not limited too:

M sulfite

M bisulfite

M metabisulfite

M thiosulfate

M hydrosulfite

M hypophosphite where M represents one or more cations which are typically either $Na^+$, $K^+$, or $NH_4$+. Fabric softeners within the invention can include between 0 percent and 20 percent antichlor by weight.

There are a number of known miscellaneous ingredients that can be added to enhance the fabric softener compositions. A sample of these ingredients are presented below. Optical brighteners, such as Leukophor BMB™ Powder sold by Sandoz can be added at concentrations of 0.2 percent to 5 percent by weight to enhance the color brightness of treated fabrics. The addition of 0.5 percent to 3.0 percent by weight fragrance such as Irish Spring sold by Intercontinental Fragrances will give a pleasing odor to the fabric after the washing process is completed. About 0.001 percent to 0.01 percent by weight of a colorant such as Nylanthrene Brilliant Blue 2RFF™ sold by Crompton & Knowles can be added to the product to make it more visible in the container so the user knows when the container is empty and needs replacing. Also, 0.5 percent to 2.0 percent by weight of a dimethyl siloxane type defoamer can be added to eliminate foam in the final rinse of the wash cycle which helps the softener absorb on the fabric and promotes more rapid and thorough draining and extracting of the final rinse water.

To use liquid fabric softeners within the invention, a desired quantity is measured out and added to a washing machine before or during a rinse cycle. In the production of solid fabric softeners, the molten composition is preferably poured into a plastic bottle ranging in size from 1 quart to 5 quarts. The composition solidifies upon cooling. In the preferably way of using the solid fabric softener, the jar containing the solid softener is inverted into a bowl. Water is sprayed up onto the exposed solid dissolving the desired amount of the fabric softener. The resulting fabric softening solution drains into the bowl, then out through a drain in the bottom of the bowl. A tube connected to the drain opening delivers the fabric softening solution either directly to the laundry machine or to a stream of water to be transferred to the laundry machine.

EXAMPLE 1

About 358 grams (hereafter abbreviated g) of Armeen M2HT™ (sold by AKZO Chemicals) and about 5 g TH Antifoam AF-30™ (a 30% active dimethyl siloxane emusion sold by Harcross) are placed in 1000 ml beaker. The beaker with the compounds is heated to 120° F. and mixed with a propeller-type agitator to form a homogeneous liquid. About 600 g of citric acid (sold by Miles Laboratories) are slowly added with mixing and heating to keep the temperature between 100–110° F. so that the mixture remains fluid. About 5 g of Irish Spring™ fragrance (sold by Intercontinental Fragrances), about 2 g Leukophor BMB powder (optical brightener sold by Sandoz) and about 6 g $Na_2SO_3$ antichlor are mixed in the molten softener mixture. When all ingredients have been added, the mixture is cooled to about 104° F. and poured into a 1 quart plastic bottle. The mixture solidifies into a solid uniform dispersion upon cooling. This fabric softening composition dispenses well, but it may be too soft in hot environments.

EXAMPLE 2

About 500 g Admox SC-1885™ (sold by Albemarle), about 240 g of Armeen M2HT™ (sold by AKZO Chemicals), about 100 g propylene glycol and about 5 g TH Antifoam $_{30}$™ (sold by Harcross) were added to a 1000 ml beaker and heated to 180° F. with occasional stirring with a propeller type mixer. At 180° F. the material in the beaker was a thixotropic liquid. About 220 g citric acid (sold by Miles Laboratories), about 5 g Leukophor BMB™ Powder (sold by Sandoz), about 5 g Irish Spring™ fragrance (sold by Intercontinental Fragrances) and about 0.01 g Nylanthrene Brilliant Blue 2RFF™ dye (sold by Crompton and Knowles) were added to the beaker.

Occasional heating was needed to keep the temperature about 170° F. If the temperature dropped significantly below 170° F., the mixture became too viscous to mix. After all the ingredients were added, the mixture was allowed to cool to about 160° F. to form a viscous, homogeneously dispersed liquid. The viscous liquid was poured into a 1 quart plastic bottle where it cooled and solidified into a solid fabric softener.

EXAMPLE 3

About 600 g of Armeen M2HT™ (sold by AKZO Chemicals) were melted in a 1000 ml beaker by heating to with agitation by a propeller mixer. About 300 g of Dequest $_{2000}$™ (amino tri(methylene phosphonic acid) sold by Monsanto) and 50 g propylene glycol were added with mixing to the beaker. The temperature was maintained t about 120° F. About 30 g of sodium hypophosphite and 5 g of Leukophor BSB™ powder (sold by Sandoz) were added to the mixture. With continued agitation, the mixture was allowed to cool to about 110° F. when it was poured into a plastic bottle. The fabric softening composition solidified in the bottle upon cooling.

EXAMPLES 4–11 AND COMPARATIVE EXAMPLE 1

Nine sample formulations were made in laboratory batches of 100 g to examine the workability of the base materials (i.e. amine softeners) and the softening ability of the base materials. The ingredients of the nine compositions are shown in Table 1.

TABLE 1

| | Sample Formulations-g/100 g total | | | | | | | | |
|---|---|---|---|---|---|---|---|---|---|
| Ingredients | 1 | 2 | 3 | 4 | 5 | 6 | 7 | 8 | Control |
| Armeen HT | 65.8 | 0 | 0 | 0 | 0 | 0 | 0 | 0 | 0 |
| Armeen 2HT | 0 | 55.8 | 0 | 0 | 0 | 0 | 0 | 0 | 0 |
| Armeen M2HT | 0 | 0 | 65.8 | 0 | 0 | 0 | 0 | 45.8 | 0 |
| Armac HT (Acetate) | 0 | 0 | 0 | 65.8 | 0 | 0 | 0 | 0 | 0 |
| Admox SC 1885 | 0 | 0 | 0 | 0 | 45.8 | 0 | 0 | 0 | 0 |
| Admox SC 1485 | 0 | 0 | 0 | 0 | 0 | 45.8 | 0 | 20 | 0 |
| Arquad 2HT-75 | 0 | 0 | 0 | 0 | 0 | | 65.8 | 0 | 0 |
| Citric Acid, Gran | 30 | 30 | 30 | 30 | 30 | 30 | 30 | 30 | 30 |
| Sodium Sulfite | 3 | 3 | 3 | 3 | 3 | 3 | 3 | 3 | 3 |
| Leukophor BMB | 0.2 | 0.2 | 0.2 | 0.2 | 0.2 | 0.2 | 0.2 | 0.2 | 0.2 |
| Silicone Emulsion Antifoam, 30% | 0.5 | 0.5 | 0.5 | 0.5 | 0.5 | 0.5 | 0.5 | 0.5 | 0.5 |
| Irish Spring Type Fragrance | 0.5 | 0.5 | 0.5 | 0.5 | 0.5 | 0.5 | 0.5 | 0.5 | 0.5 |
| TDet N30 (Harcross) | 0 | 0 | 0 | 0 | 20 | 20 | 0 | 0 | 0 |
| Propylene Glycol | 0 | 10 | 0 | 0 | 0 | 0 | 0 | 0 | 0 |
| Workablity | Yes | No | Yes | Yes | Yes | Yes | Yes | Yes | — |

The samples in Table 1 were prepared by heating the amine softener, base material to melting and then adding the remaining ingredients while mixing. Mixing is continued while the mixture cools and the viscosity increases. At the proper temperature, the mixture is still fluid enough to pour yet viscous enough to suspend the undissolved granular and powdered particles in a roughly uniform dispersion while the mixture is being poured. The composition was poured onto a watch glass to cool and solidify. Evaluation of workability was noted regarding how adaptable the lab batch would be to scale up to production sized batches. The adaptability was determined from the mixing and flow characteristics indicating whether the composition would melt into a pourable fluid while remaining viscous enough not to separate in the container.

To determine softening effectiveness, nine white terry cloth hand towels were washed in a typical front loading washing machine with industrial strength detergent, bleached, rinsed three times, extracted and dried. All nine towels were initially as identical as possible. One towel for each formulation was then processed according to the following procedure. Fifteen grams of the softening composition were weighed into a beaker to which hot (140° F.) water was added to disperse the softening composition.

One towel was placed in a washing machine and cold water was added to the low level. The sample formula solution was added to the washing machine with the towel. The washing machine was run for five minutes at which time the washing machine was drained for 30 seconds and extracted (spun) for 30 seconds. The towel was removed and the pH checked. Then, the towel was dried for 40 minutes.

The softness of each towel was evaluated by a panel of 6 people who were instructed to arrange the towels in order of softness with 1 being the softest and 9 being the hardest. The results are presented in Table 2.

TABLE 2

Panel Test for Softness

| | Participant | | | | | |
|---|---|---|---|---|---|---|
| | A | B | C | D | E | F |
| Hardest | 9 | 9 | 9 | 9 | 9 | 9 |
| | 6 | 1 | 2 | 2 | 1 | 1 |
| | 1 | 2 | 1 | 4 | 2 | 2 |
| | 4 | 6 | 4 | 6 | 4 | 6 |
| | 2 | 4 | 8 | 1 | 8 | 4 |
| | 5 | 8 | 6 | 5 | 6 | 8 |
| | 8 | 3 | 5 | 8 | 5 | 5 |
| | 3 | 5 | 7 | 3 | 3 | 7 |
| Softest | 7 | 7 | 3 | 7 | 7 | 3 |

The rankings were averaged to give relative ratings for the 9 compositions. The average rating was used to determine an overall rank where the higher the number the softer the towel is to the touch. The results are given in Table 3.

TABLE 3

Softness Ranking of Formulas

| Formula # | Frequency × Rating | Rank |
|---|---|---|
| 1 | 3 × 2 + 2 × 3 + 1 × 5 = 21 | 7 |
| 2 | 2 × 2 + 3 × 3 × 1 × 5 = 18 | 8 |
| 3 | 1 × 7 + 3 × 8 + 2 × 9 = 49 | 2 |
| 4 | 1 × 3 + 3 × 4 + 2 × 5 = 25 | 6 |
| 5 | 2 × 6 + 3 × 7 + 1 × 8 = 41 | 3 |
| 6 | 1 × 2 + 3 × 4 + 2 × 6 = 26 | 5 |
| 7 | 2 × 8 + 4 × 9 = 52 | 1 |
| 8 | 2 × 5 + 2 × 6 + 2 × 7 = 36 | 4 |
| 9 | 6 × 1 = 6 | 9 |

The results in Table 3 demonstrate that all of the amine softeners evaluated provided some degree of softening since all panel test participants unanimously chose the towel with no softener as the hardest. As to the softest, the Armeen M2HT™ ranked very close to the Arquad 2HT-75™. The Admox SC-1885™ was an acceptable third in softness. The others had less but acceptable softness.

EXAMPLES 12–18

To test iron ion removal by the acidifying materials, two tests were conducted. The first test involved immersing 1 inch by 1 inch pieces of white 100 percent cotton and 1 inch by 1 inch pieces of 100 percent polyester cloth in solutions. The solutions have softener (Armeen M2HT™) containing citric acid or amino tri(methylene phosphonic acid), i.e. Dequest 2000™. The softener and acid are present at concentrations of 2 g acid +1 gram softener per 5 gallons of 60° F. soft water. Also, 1.5 g of Ferric Nitrate nonahydrate was added to the solution. The cloth pieces were mildly stirred for five minutes and dried. The test was conducted at various pH levels adjusted appropriately with 1 normal (N) HCl or 1 N NaOH.

The cloth pieces were placed in a test tube containing 10 ml developing solution consisting of 940 ml distilled water, 50 ml 1 N HCl and 10 g potassium thiocyanate. Standards were made by successive dilution of the identical softening solution without the acidic chelating agent used in preparing the cloth pieces. Readings were done by comparing the intensity of the red color with the color developed by the standards. Table 4 shows the results of the comparison indicating the inhibiting effect of the acidic materials of the deposition of iron on the cloth pieces.

TABLE 4

Percent Fe Deposited as Percent of Control

| | Control (No acid) | Citric pH 3.0 | Dequest pH 3.0 | Citric pH 5.5 | Dequest pH 5.5 | Citric pH 9.5 | Dequest pH 9.5 |
|---|---|---|---|---|---|---|---|
| Cotton | 100 | 50 | 10 | 60 | 20 | 60 | |
| Polyester | 100 | 20 | 10 | 20 | 10 | 10 | 10 |

The results in Table 4 demonstrate that citric acid and Dequest 2000™ significantly inhibit the deposition of iron on fabrics with Dequest 2000™ working better than citric acid. Citric acid has better solidification properties.

EXAMPLES 19–26 AND COMPARATIVE EXAMPLES 2–3

Next, a similar protocol was followed to determine if these acidifying materials would remove iron that was already deposited in fabrics. Identical cloth pieces as in the above test were used. Six test pieces of each fabric were soaked in a series of 6 iron solutions made with $Fe(NO_3)_3 \cdot 9H_2O$ at respectively 100 ppm (parts per million iron content), 50 ppm, 10 ppm, 5 ppm, 1 ppm and 0.25 ppm. The cloth was stirred with the iron solution for five minutes before being removed and dried.

Test solutions contained 10 g softener (Armeen M2HT™) and 5 g acid were dissolved in 5 gallons of water. The pH was adjusted using 1 N HCl or 1 N NaOH as shown. Table 5 shows the result as a percent removal of iron from the fabric compared to the original amount of the iron as determined calorimetrically with the KSCN indicator using the method previously described.

TABLE 5

Iron Removal from Fabric

| | Distilled Water | | Citric pH 2.5 | | Citric pH 5.5 | | Deq pH 2.2 | | Deq pH 5.0 | |
|---|---|---|---|---|---|---|---|---|---|---|
| PPM Iron | Cot | Poly | Cot | Poly | Cot | Poly | Cot | Poly | Cot | Poly |
| 100 | 10 | 0 | 40 | 10 | 0 | 10 | 90 | 90 | 90 | 50 |
| 50 | 10 | 10 | 30 | 20 | 20 | 20 | 100 | 90 | 90 | 50 |
| 10 | 20 | 30 | 20 | 90 | 20 | 50 | 80 | 90 | 80 | 90 |
| 5 | 40 | 50 | 50 | 50 | 40 | 50 | 80 | 100 | 80 | 90 |
| 1 | 10 | 10 | 50 | 100 | 50 | 50 | 70 | 100 | 80 | 100 |
| .25 | 20 | 10 | 50 | 100 | 40 | 50 | 70 | 100 | 60 | 100 |
| Average | 18.3 | 18.3 | 40.0 | 61.7 | 28.3 | 38.3 | 81.6 | 95.0 | 60.0 | 80.0 |

The results in Table 5 demonstrate that these acids will inhibit the deposition of iron on fabrics significantly better than simple rinsing that would occur in water if no acid was present. It would be expected to see some reduction in iron due simply to low pH because some iron salts dissolve at low pH, which is consistent with the better results at lower pH. Even so, the chelating activity of the anion of the citric acid and Dequest $_{2000}$™ enhances iron removal significantly.

EXAMPLE 27

The effectiveness of sodium sulfite as an antichlor was verified by preparing a 5 gallon sample of water with 10 ppm available chlorine from sodium hypochlorite present as deterined by iodimetric titration. A sample solution is mixed with KI and acid. The chlorine converts the iodide ion to iodine which has a yellow color in solution. The resulting solution is titrated with sodium thiosulfate until the yellow color disappears.

A sample of the softener solid with 0.5 g $Na_2SO_3$ was dissolved and stirred into a 5 gallon sample. No available chlorine remained as tested with O-tolidine hydrochloride (OTO) solution. This is a spot test for chlorine. The intensity of the yellow color formed by the OTO will indicate the concentration of active chlorine, and the absence of yellow color will indicate the absence of active chlorine.

What is claimed is:

1. A homogeneous solid cast fabric softener composition comprising between about 5 and 95 percent by weight citric acid, greater than about 5 percent by weight of a cationic surfactant, and a reducing agent capable of reducing hypochlorite selected from the group consisting of sodium, potassium, and ammonium sulfates, bisulfites, metabisulfites, thiosulfates, hydrosulfites, hypophosphites, and any mixture thereof.

2. The solid cast fabric softener composition of claim 1, further comprising an amine oxide.

3. The solid cast fabric softener composition of claim 1, wherein said cationic surfactant is a quaternary ammonium salt.

4. The solid cast fabric softener composition of claim 3, further comprising an ethoxylated fatty acid.

5. The solid cast fabric softener composition of claim 3, further comprising additional ingredients selected from the group consisting of an optical brightener, a fragrance, a colorant, a defoamer and any mixture thereof.

6. The solid cast fabric softener composition of claim 1, further comprising a fatty amine softener not capable of reducing hypochlorites.

7. The solid cast fabric softener composition of claim 1, further comprising a dimethyl alkyl amine oxide present in a concentration greater than about 20 percent by weight.

8. A method of softening a fabric in a washing machine, comprising:

(a) contacting a homogeneous solid cast fabric softener composition comprising greater than about 5% by weight of a cationic surfactant and between about 5% and 95% by weight citric acid, said solid cast fabric softener composition having a volume of 1 quart to 5 quarts, with a sufficient amount of water to dissolve at least a portion of the solid cast fabric softener composition, thereby forming a dissolved portion of the solid cast fabric softener composition;

(b) introducing said dissolved portion of the solid cast fabric softener composition into a washing machine containing a fabric to be softened at a time to be effective in softening the fabric during a rinse cycle;

(c) agitating the fabric, dissolved portion of the solid cast fabric softener composition, and water in the washing machine during the rinse cycle;

(d) removing at least a portion of the water from the washing machine; and (e) recovering the softened fabric from the washing machine.

9. The method of claim 8, wherein the cationic surfactant in the contacted homogeneous solid cast fabric softener composition comprises a quaternary ammonium salt.

* * * * *

UNITED STATES PATENT AND TRADEMARK OFFICE

CERTIFICATE OF CORRECTION

PATENT NO. : 6,110,886
DATED : August 29, 2000
INVENTOR(S) : William H. Scepanski It is certified that error appears in the above-identified patent and that said Letters Patent is hereby corrected as shown below:

On the title page: "SOLID COMPOSITION FABRIC SOFTENING COMPOSITIONS FOR APPLICATION IN A WASHING MACHINE" should be --FABRIC SOFTENING COMPOSITIONS FOR APPLICATION IN A WASHING MACHINE--.

Column 2, line 66, insert --discloses-- between "et al." and "a".
Column 4, line 5, delete paragraph indent; should be part of the previous paragraph.
Column 6, line 64, "preferably" should be --preferable--.
Column 7, line 54, "$_{30}$™" should be --30™--.
Column 8, line 8, delete "to" at the end of the sentence.
Column 8, line 10, "$_{2000}$™" should be --2000™--.
Column 8, line 12, "t" should be --at--.
Column 10, line 55, "$_{3}$.9$H_2$0" should be --$_{3}$•9$H_2$0--.
Column 10, line 66, "calorimetrically" should be --colorimetrically--.
Column 11, line 18, delete paragraph indent.
Column 11, line 25, "$_{2000}$™" should be --2000™--.
Column 11, line 32, "deterined" should be --determined--.
Column 11, line 50, "sulfates" should be --sulfites--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*